US009056755B1

(12) United States Patent
Moy

(10) Patent No.: US 9,056,755 B1
(45) Date of Patent: Jun. 16, 2015

(54) COMPACT AIR COMPRESSOR AND VEHICLE JACK

(76) Inventor: Daniel W. Moy, Londondery, NH (US)

( * ) Notice: Subject to any disclaimer, the term of this patent is extended or adjusted under 35 U.S.C. 154(b) by 910 days.

(21) Appl. No.: 13/268,218

(22) Filed: Oct. 7, 2011

Related U.S. Application Data

(60) Provisional application No. 61/390,770, filed on Oct. 7, 2010.

(51) Int. Cl.
*B66F 3/24* (2006.01)

(52) U.S. Cl.
CPC ..... *B66F 3/24* (2013.01)

(58) Field of Classification Search
CPC ..... B66F 3/24; B66F 3/40; B66F 5/04; B66F 7/08; B66F 2700/05
USPC ..... 254/93 HP, 88, 93 R, 89 H
See application file for complete search history.

(56) References Cited

U.S. PATENT DOCUMENTS

| | | | | |
|---|---|---|---|---|
| 2,495,092 | A | 1/1950 | Cox et al. | |
| 3,565,398 | A | 2/1971 | Floria | |
| 3,695,582 | A | 10/1972 | Clay | |
| 3,843,092 | A * | 10/1974 | Oehler | 254/93 HP |
| 3,994,474 | A * | 11/1976 | Finkbeiner | 254/88 |
| 4,560,145 | A | 12/1985 | Widmer | |
| 4,741,086 | A | 5/1988 | Orndorff, Jr. | |
| 6,082,708 | A * | 7/2000 | Mullican et al. | 254/93 HP |
| 6,513,418 | B1 * | 2/2003 | Simmons et al. | 92/92 |
| 6,877,200 | B2 | 4/2005 | Villareal | |
| 6,918,575 | B2 * | 7/2005 | Cadrain et al. | 254/88 |
| 6,929,249 | B1 * | 8/2005 | Kim | 254/93 HP |
| 8,215,616 | B2 * | 7/2012 | Schwarz | 254/93 HP |
| 2009/0140222 | A1 * | 6/2009 | Schwarz | 254/93 HP |

* cited by examiner

*Primary Examiner* — Lee D Wilson
(74) *Attorney, Agent, or Firm* — Robert C. Montgomery; Montgomery Patent and Design LP

(57) ABSTRACT

A compact air compressor and vehicle jack comprises a case, an air bladder, and an air compressor. The case comprises a durable two-piece construction further comprising a plurality of latches and a carrying handle. The air bladder comprises a durable inflatable vessel located internally within the case. The bladder is capable of withstanding the weight of a car. An internal electric air compressor inflates the air bladder. Power to the air compressor is provided via a cigarette lighter adapter. In use, a user would undo the latches, place the case beneath the vehicle, supply power to the air compressor using an external switch, and inflate the bladder until the vehicle achieves a desired height.

16 Claims, 5 Drawing Sheets

COMPACT AIR COMPRESSOR AND VEHICLE JACK

RELATED APPLICATIONS

The present invention was first described in and claims the benefit of U.S. Provisional Application No. 61/390,770 filed on Oct. 7, 2010, the entire disclosures of which are incorporated herein by reference.

FIELD OF THE INVENTION

The present invention relates generally to an air compressor operated vehicle jack, and in particular, to an air compressor operated vehicle jack having a compactable construction.

BACKGROUND OF THE INVENTION

Roadside vehicle repairs, such as tire changing, are an all too common occurrence. Quite often, the remedy for these situations involves accessing the underside of the vehicle or lifting the vehicle in order to remedy the situation. Usually this is accomplished via a car jack included in most vehicles.

Car jacks involve the use of physical exertion through a lever or screw system to develop the power necessary to raise the vehicle. Often, the physical exertion required is beyond that which is capable by the operator, and thus the service of a tow truck is required to perform the necessary repairs or to tow the vehicle to somewhere where the proper equipment is available. These same problems exist while raising the vehicle to change oil or for other maintenance or repairs.

Various attempts have been made to provide alternate methods for lifting a vehicle in order to perform repairs. Examples of these attempts can be seen by reference to several U.S. patents, including U.S. Pat. No. 2,495,092; U.S. Pat. No. 3,565,398; U.S. Pat. No. 3,695,582; U.S. Pat. No. 4,560,145; U.S. Pat. No. 4,741,086; U.S. Pat. No. 6,082,708; and U.S. Pat. No. 6,877,200.

However, none of these designs are similar to the present invention. While these apparatuses fulfill their respective, particular objectives, each of these references suffer from one (1) or more disadvantages. Many such apparatuses are not easy to transport or move manually. Many such apparatuses require fairly complicated setup in order to use. Many such apparatuses are not conveniently compactable for storage between uses. Many such apparatuses require maintenance of power supplies. Many such apparatuses are complicated or physically demanding to operate and adjust. Accordingly, there exists a need for a vehicle lifting apparatus with a compact configuration and simple and easy means of operation. The development of the present invention substantially departs from the conventional solutions and in doing so fulfills this need.

SUMMARY OF THE INVENTION

In view of the foregoing references, the inventor recognized the aforementioned inherent problems and observed that there is a need for a vehicle jack which is electrically-operated in a simple manner and adapted for simple manual transport and compact storage. Thus, the object of the present invention is to solve the aforementioned disadvantages and provide for this need.

To achieve the above objectives, it is an object of the present invention to provide a compact air compressor and vehicle jack for lifting an end portion of a vehicle for various repairs that can be utilized in a portable manner. The apparatus comprises a base, a lid, an air bladder, and an air compressor.

Another object of the present invention is to comprise the base and lid portions of rectangular half-portions of a metal carrying case, similar to a briefcase, which provide containment for the air bladder and air compressor. The base and lid further comprise a plurality of joining latches and a carrying handle which provide convenient compact configuration and transportation of the apparatus.

Yet still another object of the present invention is to lift the vehicle utilizing the integral air bladder. The air bladder comprises a heavy-duty inflatable pressure vessel affixed both the base and lid portions. The air bladder can be inflated with a volume of compressed air is supplied by the internal air compressor and powered via connection to a standard 12-volt cigarette lighter power adapter of the vehicle.

Yet still another object of the present invention is to provide the lid portion of the apparatus with a flat anti-skid surface to stabilize the vehicle and the apparatus during use. The anti-skid surface provides a high-friction interface upon contact with a bottom surface of the vehicle.

Yet still another object of the present invention is to comprise a plurality of rubber or plastic cylindrical foot pads along a bottom surface of the base to provide additional stability of the vehicle and the apparatus upon a ground surface or a paved surface.

Yet still another object of the present invention is to provide simple actuation of the apparatus using a power switch that automatically inflates the bladder.

Yet still another object of the present invention is to provide an air compressor housing that provides protection for the air compressor during and between uses.

Yet still another object of the present invention is to provide the base with a "C"-shaped spring storage clip affixed to a front surface for secure retention of a power cord and adapter of the apparatus between uses.

Yet still another object of the present invention is to comprise the air bladder of a heavy-duty inflatable rubber pressure vessel of sufficient strength to support a motor vehicle.

Yet still another object of the present invention is to comprise a first port and a second port providing pneumatic communication in fluid communication with a pressure relief valve and the compressor, respectively. The first port and second port enable deflation and inflation of the apparatus.

Yet still another object of the present invention is to comprise a cord recoil mechanism providing a compact means to store a length of cord between the power adapter and the air compressor. The recoil mechanism provides a slight tension upon the cord such that after the power adapter is detached from the cigarette lighter, the recoil mechanism subsequently winds up and stores the cord.

Yet still another object of the present invention is to provide a method of utilizing the device that provides a unique means of procuring the apparatus, placing the apparatus under a side of a vehicle, plugging the power adapter into a cigarette lighter, initiating the air compressor to inflate the bladder by pressing the switch to an "ON" position, filling the bladder to a desired height, pressing the switch to an "OFF" position, performing needed tasks while the vehicle is jacked off the ground surface, lowering and removing the apparatus, and benefiting from reduced effort and increased safety afforded a user of the present invention.

Further objects and advantages of the present invention will become apparent from a consideration of the drawings and ensuing description.

BRIEF DESCRIPTION OF THE DRAWINGS

The advantages and features of the present disclosure will become better understood with reference to the following more detailed description and claims taken in conjunction with the accompanying drawings, in which like elements are identified with like symbols, and in which:

DESCRIPTIVE KEY

Figure 1:
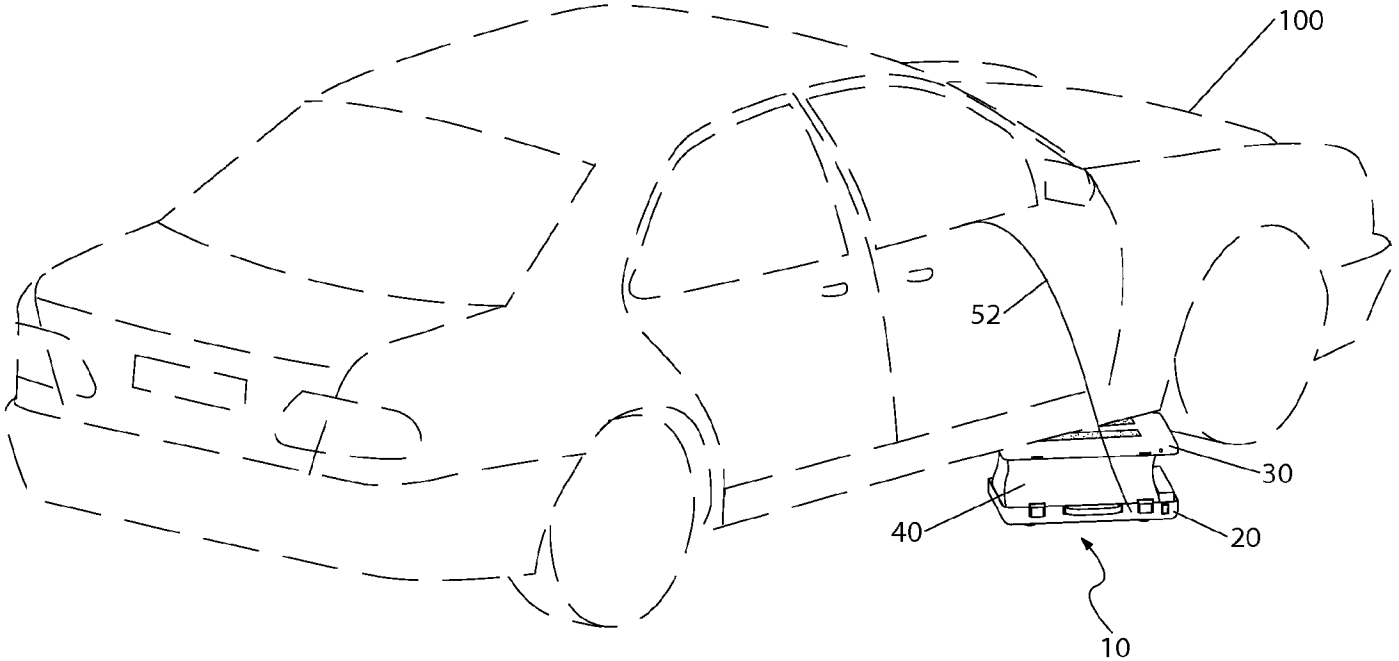
FIG. 1 is an environmental view of a compact air compressor and vehicle jack 10, according to a preferred embodiment of the present invention.

10 compact air compressor and vehicle jack
20 base
22 latch
23 keeper
24 handle
30 lid
32 anti-skid surface
33 foot pad
34 pressure relief valve
36 first port
40 bladder
45 switch
50 power adapter
52 cord
53 recoil mechanism
54 storage clip
60 air compressor housing
62 air compressor
64 second port
66 air inlet port
100 vehicle
102 fastener

DETAILED DESCRIPTION OF THE PREFERRED EMBODIMENT

In accordance with the invention, the best mode is presented in terms of a preferred embodiment, herein depicted within FIGS. 1 through 4. However, the disclosure is not limited to a single described embodiment and a person skilled in the art will appreciate that many other embodiments are possible without deviating from the basic concept of the disclosure and that any such work around will also fall under its scope. It is envisioned that other styles and configurations can be easily incorporated into the teachings of the present disclosure, and only one particular configuration may be shown and described for purposes of clarity and disclosure and not by way of limitation of scope.

The terms "a" and "an" herein do not denote a limitation of quantity, but rather denote the presence of at least one of the referenced items.

Referring now to FIG. 1, an environmental view of a compact air compressor and vehicle jack (herein described as the "apparatus") 10, according to a preferred embodiment of the present invention, is disclosed. The apparatus 10 comprises a base 20, a lid 30, an air bladder 40, an air compressor 62, and a power adapter 50. The base 20 and lid 30 portions comprise rectangular half-portions of a metal carrying case which provide containment of said air bladder 40 and air compressor 62 within. Said base 20 and lid 30 comprise a strong construction capable of supporting a weight associated with lifting an end portion of a vehicle 100 to change a tire or make various repairs. Said base 20 and lid 30 further comprise a plurality of joining latches 22 and a carrying handle 24 which provide convenient compact configuration and transportation of the apparatus 10.

The air bladder 40 comprises a heavy-duty inflatable pressure vessel affixed to and positioned between said base 20 and lid 30 portions. Once the apparatus 10 is positioned under the vehicle 100, a volume of compressed air is supplied by the internal air compressor 62 to inflate the bladder 40, thereby lifting said vehicle 100 (see FIG. 3). Power is provided to the compressor 62 via a standard 12-volt cigarette lighter power adapter 50 and a cord 52 allowing a user to utilize a battery portion of the vehicle 100 to power the apparatus 10.

Figure 2A:
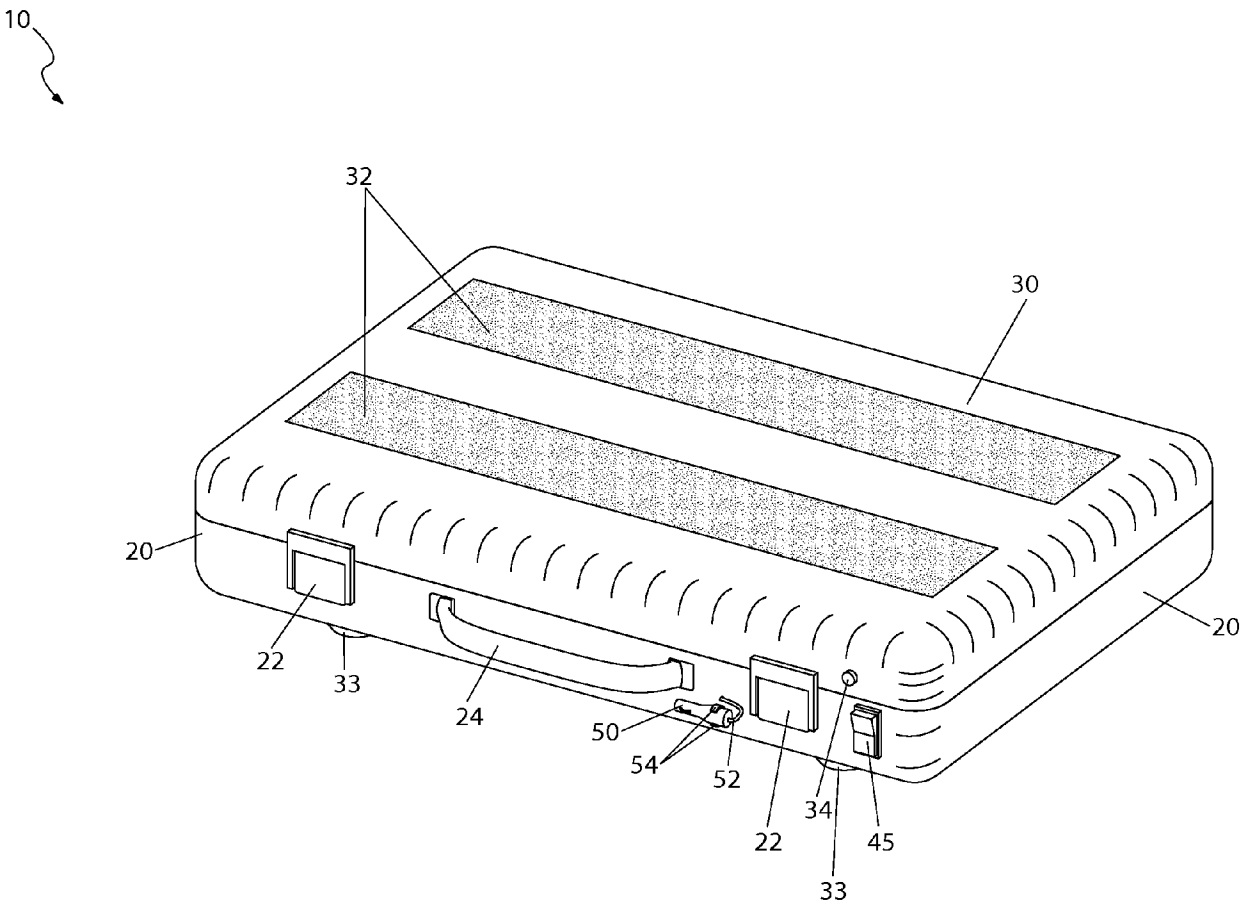
FIG. 2*a* is a perspective view of a compact air compressor and vehicle jack 10 depicting a collapsed and stowed state, according to a preferred embodiment of the present invention.
Figure 2B:
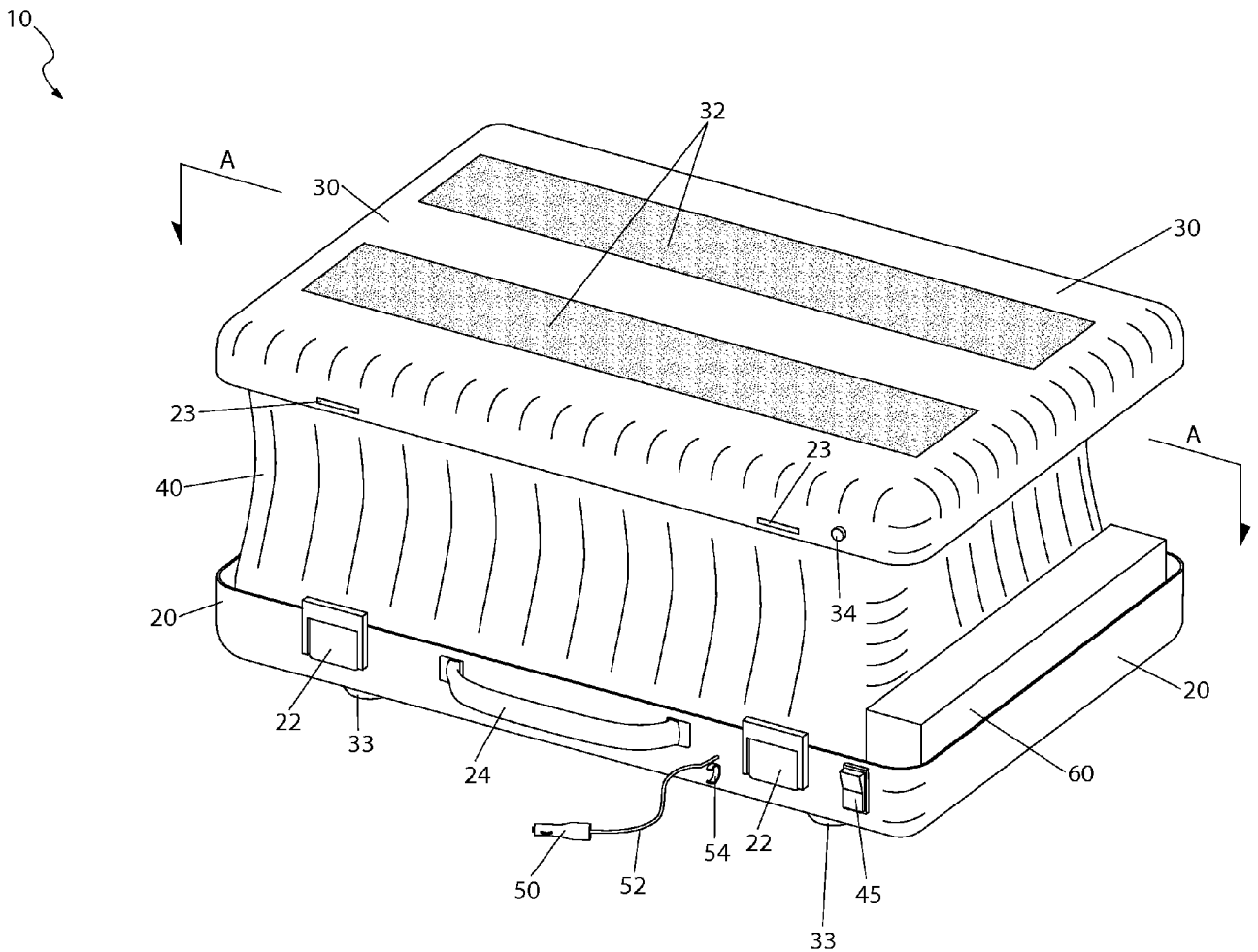
FIG. 2*b* is a perspective view of a compact air compressor and vehicle jack 10 depicting an inflated state, according to a preferred embodiment of the present invention.

Referring now to FIGS. 2*a* and 2*b*, perspective views of the apparatus 10 depicting collapsed and inflated states, according to the preferred embodiment of the present invention, are disclosed. The apparatus 10 comprises a plurality of latches 22, corresponding latch keepers 23, a pressure relief valve 34, an activation switch 45, and a power adapter 50. When the bladder 40 is deflated, the apparatus 10 provides a compact form similar to a briefcase via attachment of the base 20 and a lid 30 portions using the latches 22. Said latches 22 permanently attached to the base 20 being arranged along front and rear upper edge portions. Said latches 22 are envisioned to comprise commercially available units which work in conjunction with hook-shaped latch keepers 23 being correspondingly positioned along a lower mating edge portion of the lid 30.

The lid portion 30 of the apparatus 10 comprises a flat upper surface comprising an anti-skid surface 32 to stabilize said vehicle 100 and the apparatus 10 during jacking. Said anti-skid surface 32 comprises an adhesively bonded rubber sheet material which provides a high-friction interface upon contact with a bottom surface of the vehicle 100. Furthermore, the apparatus 10 is envisioned to comprise a plurality of rubber or plastic cylindrical foot pads 33 along a bottom surface of the base 20 preferably being located at corner areas to provide additional stability of the vehicle 100 and the apparatus 10 upon a ground surface or a paved surface. Said foot pads 33 are envisioned to be securely fastened to the base 20 using common fasteners 102 such as rivets, screws, or the like.

In use, a user places the apparatus 10 beneath a vehicle 100, usually adjacent to a tire portion, and presses the power switch 45 to an "ON" position, thus inflating the bladder 40 and causing a corner portion of the vehicle 100 to be lifted. The vehicle 100 is now in a position to change a flat tire or perform similar tasks. The power switch 45 is preferably a two-position toggle switch device; however, it is understood that various switch types may be utilized such as button switches, sliding switches, and the like, with equal benefit. Inflation of the bladder 40 is accomplished by plumbing a volume of compressed air 66 produced by the air compressor 62 into said bladder via a second port 64 (see FIG. 3). The compressor 62 is protectively housed within an air compressor housing 60 preferably comprising a rectangular metal or plastic enclosure being sized so as to fit between the base 20 and lid 30 portions when latched together. Said air compressor 62 provides a means to pressurize ambient air which is in turn delivered into the bladder 40, thereby causing said bladder 40 to increase in height to approximately eight (8) to twelve (12) inches being sufficient to lift a tire portion of the vehicle 100 off a ground or paved surface. Following inflation of the bladder 40 and servicing of the vehicle 100, said bladder 40 may be deflated quickly and easily via a pressure relief valve 34 located along a front surface of the lid 30. Said pressure relief valve 34 is in pneumatic communication with said bladder 40 and preferably comprises a common digit-operated "poppet" valve or equivalent air regulating device. Upon complete deflation of the bladder 40, the latches 22 and keepers 23 may be secured, thereby returning the apparatus 10 to a stowed and/or transportable state.

The apparatus 10 is envisioned to receive 12-volt DC power from an existing electrical system of the vehicle 100 via a power adapter 50 and corresponding cord 52. Said cord 52 is to be of sufficient length so as to extend from the apparatus 10 while positioned under the vehicle 100, to a cigarette lighter portion of the vehicle 100 located on a dashboard portion. The base 20 provides a means to securely store said adapter 50 when not in use, via a "C"-shaped spring storage clip 54 which is affixed to a front surface of the base 20 (also see FIG. 3).

Figure 3:
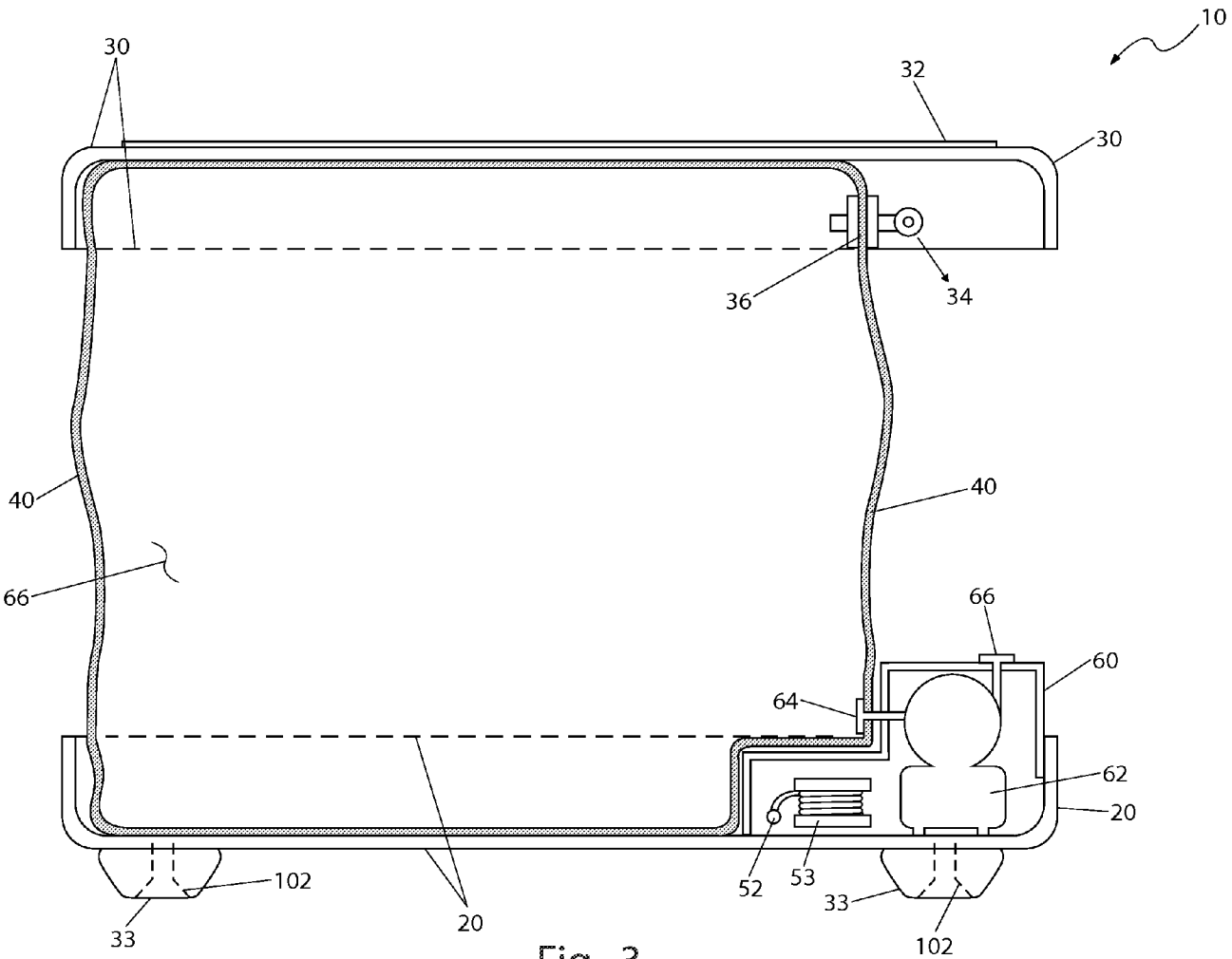
FIG. 3 is a section view of the compact air compressor and vehicle jack 10 taken along section line A-A (see FIG. 2*b*), according to a preferred embodiment of the present invention; and, FIG. 4 is an electrical block diagram of the compact air compressor and vehicle jack 10, according to a preferred embodiment of the present invention.

Referring now to FIG. 3, a section view of the compact air compressor and vehicle jack 10 taken along section line A-A (see FIG. 2*b*), according to a preferred embodiment of the present invention, is disclosed. The air bladder 40 comprises a heavy-duty inflatable rubber pressure vessel affixed to the base 20 and lid 30 portions preferably using industrial adhesives. The bladder 40 further comprises an integral first port 36 and second port 64. Said first port 36 provides pneumatic communication with the aforementioned pressure relief valve 34 to deflate the bladder. The second port 64 provides pneumatic communication with the compressor 62 to inflate the bladder 40. The air compressor 62 is preferably a miniature diaphragm-type 12-volt DC unit which internally plumbs supply output air to the second port portion 64 of the air bladder 40 and also comprises an air inlet port 66 mounted upon the air compressor housing 60. The base 20 provides an attachment means to a cord recoil mechanism 53 along a bottom inner surface. Said recoil mechanism 53 is envisioned to be of a coil-spring-type and provides a compact means to store a length of cord 52 between the power adapter 50 and the air compressor 62. The recoil mechanism 53 is envisioned to provide a slight tension upon said cord 52 while said cord 52 is extended and the power adapter portion 50 is plugged into the cigarette lighter portion of the vehicle 100. After normal use of the apparatus 10 the power adapter 50 is detached from the cigarette lighter and the recoil mechanism 53 subsequently winds up and stores the cord 52 (see FIG. 2).

Figure 4:
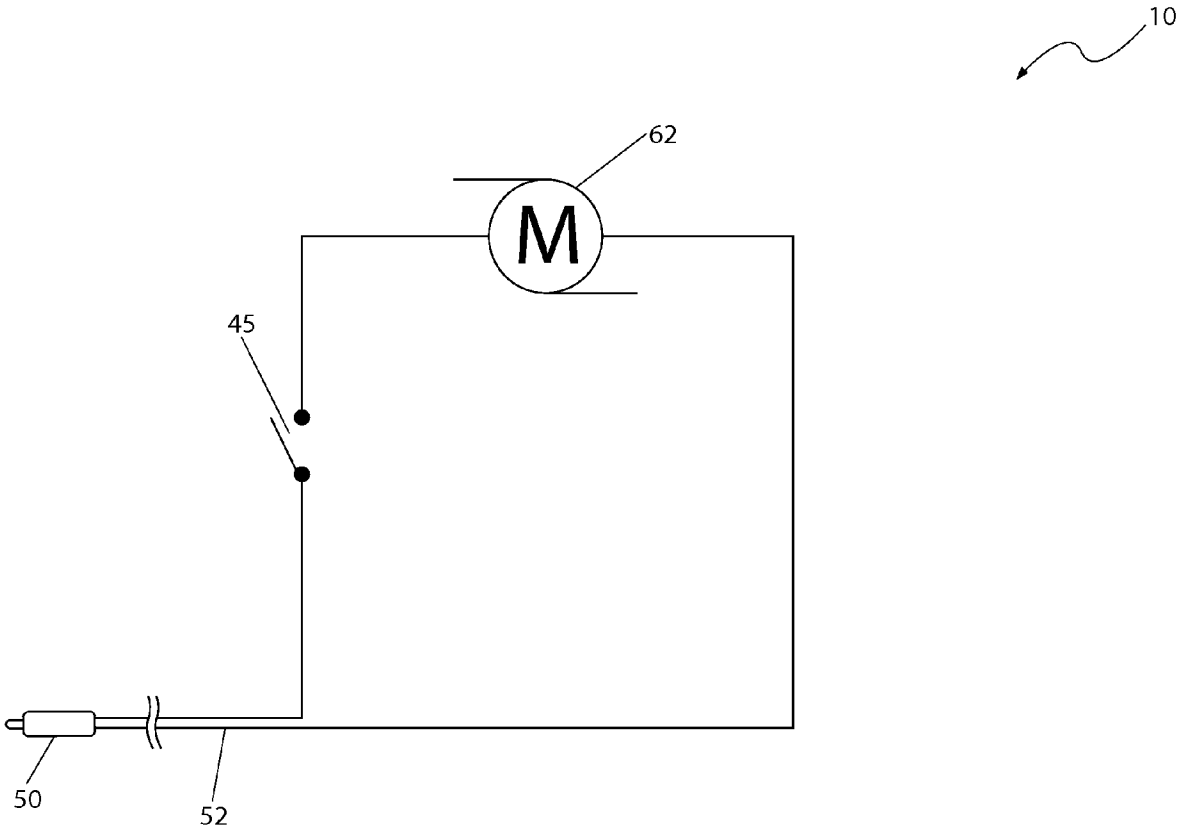

Referring now to FIG. 4, an electrical block diagram of the apparatus 10, according to a preferred embodiment of the present invention, is disclosed. The apparatus 10 comprises a simple 12-volt DC circuit comprising the power adapter 50, the cord 52, a switch 45, and the motor portion of the air compressor 62. Power from the battery portion of the vehicle 100 is conducted through a cigarette lighter within the vehicle 100 to the removably attachable power adapter 50 and cord 52 portions. A common "ON-OFF" switch 45 controls a flow of current to the motor portion of the air compressor 62 to initiate inflation of the bladder portion 40 of the apparatus 10.

It is envisioned that other styles and configurations of the present invention can be easily incorporated into the teachings of the present invention, and only one particular configuration shall be shown and described for purposes of clarity and disclosure and not by way of limitation of scope.

The preferred embodiment of the present invention can be utilized by the common user in a simple and effortless manner with little or no training. After initial purchase or acquisition of the apparatus 10, it would be installed as indicated in FIG. 1.

The method of utilizing the apparatus 10 may be achieved by performing the following steps: procuring the apparatus 10; storing the apparatus 10 in a trunk portion of a vehicle 100 until needed to perform tasks requiring jacking of a vehicle 100 such as changing a flat tire, inspecting a vehicle undercarriage, or the like; removing the apparatus 10 from a trunk portion of the vehicle 100 when needed; placing the apparatus 10 under a corner or side portion of the vehicle 100 such as under a rocker panel, bumper, or the like; manually releasing the power adapter 50 from the storage clip 54; extending the power adapter 50 and the retractable cord 52 outwardly a sufficient length; plugging the power adapter 50 into a cigarette lighter socket portion of the vehicle 100; releasing the latches 22 from the keepers 23 to release the base 20 from the lid 30, thereby allowing the bladder 40 to expand during inflation; initiating the air compressor 62 to inflate the bladder 40 by pressing the switch 45 to an "ON" position; allowing a period of time for the bladder 40 to fill with compressed air 66 and lift the vehicle 100 to a desired height; pressing the switch 45 to an "OFF" position, thereby ceasing lifting of the vehicle 100; performing needed tasks while the vehicle 100 is jacked off the ground surface; and, benefiting from reduced effort and increased safety afforded a user of the present invention 10.

The method of lowering and removing the apparatus 10 from the vehicle 100 may be achieved by performing the following steps: lowering the vehicle 100 by pressing the pressure relief valve 34 to allow the compressed air 66 to escape from the bladder 40 until said bladder 40 deflates completely and the vehicle 100 is lowered to the ground surface; fastening the latches 22 and keepers 23 to secure the apparatus 10 in a closed state; detaching the power adapter 50 from the cigarette lighter; allowing the recoil mechanism 53 to wind and contain the cord 52; storing the power adapter 50 within the storage clip 52; and, storing the apparatus 10 in a trunk portion of the vehicle 100 until needed again.

The foregoing descriptions of specific embodiments have been presented for purposes of illustration and description. They are not intended to be exhaustive or to limit to the precise forms disclosed and many modifications and variations are possible in light of the above teachings. The embodiments were chosen and described in order to best explain principles and practical application to enable others skilled in the art to best utilize the various embodiments with various modifications as are suited to the particular use contemplated.

What is claimed is:

1. A jack, comprising:

a durable base, comprising a five-sided enclosure, having an open end and an interior;

a durable lid covering said base open end and removably secured to said base;

an air bladder having a lower end affixed within said base and an upper end affixed within said lid;

an air compressor mounted within a housing located within said base and in fluid communication with said air bladder;

a control means in electrical communication with said air compressor; and, a power adapter housed within said base and extendable therefrom, said power adapter in electrical communication with said control means, and said power adapter secured to a clamp portion located on an outer surface of said base, further comprising:

a cord, having a first end comprising a cigarette lighter adapter adapted to be removably attached to and in electrical communication with a power source and a second end; and, a cord recoil mechanism housed within said base and retaining said cord second end;

wherein said base and lid comprise rectangular half-portions of a metallic carrying case;

wherein said jack is capable of supporting a weight associated with lifting load placed thereon;

wherein said cord recoil mechanism provides a compact means of storing said cord;

wherein said cord recoil mechanism provides a tension to said cord when said cord is extended and said cigarette lighter adapter is in electrical communication with a power source and retracts said cord when said tension is released; and, wherein said air compressor delivers a flow of air to said air bladder, thereby lifting said lid and a load thereon.

2. The jack of claim 1, wherein said lid is removably secured to said base with at least one latch.

3. The jack of claim 1, further comprising a carrying handle located on said base.

4. The jack of claim 1, further comprising a plurality of foot pads located along a bottom surface of said base.

5. The jack of claim 1, wherein said air bladder is sized to raise said lid approximately eight to twelve inches relative to said base when fully inflated.

6. The jack of claim 1, further comprising a pressure relief valve in fluid communication with said;

wherein said air bladder is relieved of said forced air when said pressure relief valve is actuated, thereby lowering a load on said jack.

7. The jack of claim 1, wherein said air compressor further comprises a miniature diaphragm-type 12-volt DC unit.

8. The jack of claim 1, wherein said control means further comprises a two-position toggle switch in electrical communication with said power adapter.

9. A jack, comprising:

a durable base, comprising a five-sided enclosure, having an open end and an interior;

a durable lid covering said base open end removably secured to said base, further comprising an anti-skid surface bonded to an upper surface thereof;

an air bladder having a lower end affixed within said base and an upper end affixed within said lid;

an air compressor mounted within a housing located within said base and in fluid communication with said air bladder;

a control means in electrical communication with said air compressor; and, a power adapter housed within said base and extendable therefrom, said power adapter in electrical communication with said control means, and said power adapter secured to a clamp portion located on an outer surface of said base, further comprising:

a cord, having a first end comprising a cigarette lighter adapter adapted to be removably attached to and in electrical communication with a power source and a second end; and, a cord recoil mechanism housed within said base and retaining said cord second end;

wherein said base and lid comprise rectangular half-portions of a metallic carrying case;

wherein said jack is capable of supporting a weight associated with lifting load placed thereon;

wherein said cord recoil mechanism provides a compact means of storing said cord;

wherein said cord recoil mechanism provides a tension to said cord when said cord is extended and said cigarette lighter adapter is in electrical communication with a power source and retracts said cord when said tension is released; and, wherein said air compressor delivers a flow of air to said air bladder, thereby lifting said lid and a load thereon.

10. The jack of claim 9, wherein said lid is removably secured to said base with at least one latch.

11. The jack of claim 9, further comprising a carrying handle located on said base.

12. The jack of claim 9, further comprising a plurality of foot pads located along a bottom surface of said base.

13. The jack of claim 9, wherein said air bladder is sized to raise said lid approximately eight to twelve inches relative to said base when fully inflated.

14. The jack of claim 9, further comprising a pressure relief valve in fluid communication with said;

wherein said air bladder is relieved of said forced air when said pressure relief valve is actuated, thereby lowering a load on said jack.

15. The jack of claim 9, wherein said air compressor further comprises a miniature diaphragm-type 12-volt DC unit.

16. The jack of claim 9, wherein said control means further comprises a two-position toggle switch in electrical communication with said power adapter.

* * * * *